US012595913B2

(12) United States Patent
Conde Zelocuatecatl et al.

(10) Patent No.: US 12,595,913 B2
(45) Date of Patent: Apr. 7, 2026

(54) DOUBLE OVEN WITH TOASTER AND AIR FRYER

(71) Applicant: Midea Group Co., Ltd., Beijiao (CN)

(72) Inventors: Felix Conde Zelocuatecatl, Louisville, KY (US); Richard W. Cowan, Louisville, KY (US); Vern A. Neal, Louisville, KY (US); Jody Anne Swann, Prospect, KY (US); Charles Cardwell, II, Louisville, KY (US)

(73) Assignee: MIDEA GROUP CO., LTD., Beijiao (CN)

( * ) Notice: Subject to any disclaimer, the term of this patent is extended or adjusted under 35 U.S.C. 154(b) by 828 days.

(21) Appl. No.: 17/567,652

(22) Filed: Jan. 3, 2022

(65) Prior Publication Data

US 2023/0213203 A1 Jul. 6, 2023

(51) Int. Cl.
*F24C 3/00* (2006.01)
*F24C 11/00* (2006.01)
(Continued)

(52) U.S. Cl.
CPC ..... *F24C 3/008* (2013.01); *F24C 11/00* (2013.01); *F24C 14/02* (2013.01); *F24C 15/10* (2013.01); *F24C 15/18* (2013.01); *F24C 15/325* (2013.01)

(58) Field of Classification Search
CPC ... A47J 37/0641; A47J 37/1266; F24C 15/16; F24C 14/02; F24C 15/325; F24C 15/322;
(Continued)

(56) References Cited

U.S. PATENT DOCUMENTS 2,854,559 A * 9/1958 Ammerman ..... F24C 7/06 219/532
4,338,911 A 7/1982 Smith
(Continued)

FOREIGN PATENT DOCUMENTS

AU 700110 B2 12/1998
AU 2009202799 A1 * 1/2010 ..... A47J 37/0635
DE 202017102536 U1 9/2018

OTHER PUBLICATIONS

Screen Captures from YouTube video clip entitled "KitchenAid 27 Combination Convection Double Wall Oven KOCE507EWH", 3 pages, uploaded on Jun. 8, 2015 by "Abt Electronics". Retrieved from the internet: https://www.youtube.com/watch?v=svn6otbqVi4 (Year: 2015).*

(Continued)

*Primary Examiner* — Allen R. B. Schult
*Assistant Examiner* — Amy E Carter
(74) *Attorney, Agent, or Firm* — Gray Ice Higdon

(57) ABSTRACT

A cooking appliance is provided that includes a cooktop and a double oven. A first oven may be a standard radiant or convection oven. A second oven comprises a combined toaster-oven and air fryer. The combined toaster-oven and air fryer can include a heat source that is the same as or different from the heat source of the first oven. The heat source of the second oven can include a plurality of graphite bake heating elements and a plurality of graphite broil elements. The second oven includes a fan disposed configured to provide targeted air flow directly onto a food load that is placed inside said second oven.

17 Claims, 9 Drawing Sheets

(51) Int. Cl.
*F24C 14/02* (2006.01)
*F24C 15/10* (2006.01)
*F24C 15/18* (2006.01)
*F24C 15/32* (2006.01)

(58) Field of Classification Search
CPC ..... F24C 11/00; F24C 14/00; H05B 1/0263; H05B 6/6473
USPC ..... 126/21 A, 19 R, 21 R, 99; 219/394, 398, 219/395, 400
See application file for complete search history.

(56) References Cited

U.S. PATENT DOCUMENTS 4,493,976 A * 1/1985 Wilson ..... F24C 14/02 126/21 R
5,525,782 A 6/1996 Yoneno et al.
5,676,044 A 10/1997 Lara, Jr.
5,928,694 A 7/1999 Ubert et al.
5,988,154 A 11/1999 Douglas et al.
6,013,296 A 1/2000 Kester et al.
6,545,251 B2 4/2003 Allera et al.
6,732,637 B2 5/2004 Artt
6,872,926 B1 3/2005 Arntz et al.
7,235,763 B2 6/2007 Christiaansen et al.
7,446,282 B2 11/2008 Shei et al.
7,708,008 B2 5/2010 Elkasevic et al.
9,534,794 B2 * 1/2017 Rogers ..... F24C 15/322
9,901,212 B2 2/2018 Stanger
2003/0077078 A1 * 4/2003 Wu ..... H05B 3/145 392/407
2004/0200827 A1 * 10/2004 Bennett ..... F24C 7/082 219/400
2007/0029312 A1 * 2/2007 Kim ..... F24C 15/325 219/681
2007/0108179 A1 * 5/2007 Hines, Jr. ..... F24C 7/087 219/400
2008/0185373 A1 * 8/2008 Elkasevic ..... F24C 15/006 219/394
2008/0202354 A1 * 8/2008 Lee ..... F24C 7/082 99/476
2010/0006561 A1 * 1/2010 Hensel ..... A47J 37/0807 219/483
2010/0213184 A1 * 8/2010 Harris ..... F24C 7/088 219/385
2010/0229847 A1 * 9/2010 Rogers ..... F24C 15/322 219/400
2011/0259870 A1 * 10/2011 Rogers ..... F24C 15/006 219/400
2012/0152936 A1 6/2012 Claesson et al.
2013/0019852 A1 * 1/2013 Yu ..... F24C 7/06 126/19 R
2013/0291854 A1 * 11/2013 Johnson ..... F24C 15/322 126/21 A
2015/0101592 A1 * 4/2015 Cadima ..... F24C 3/087 126/41 R
2015/0354829 A1 * 12/2015 Adelmann ..... F24C 15/162 126/19 R
2016/0195282 A1 * 7/2016 Kim ..... F24C 3/087 126/21 A
2016/0316525 A1 10/2016 Vainionpaa
2017/0089590 A1 3/2017 Bruin-Slot et al.
2017/0224161 A1 8/2017 Li et al.
2018/0180297 A1 6/2018 Greenwood et al.
2018/0289212 A1 10/2018 Sladecek et al.

OTHER PUBLICATIONS

Frigidaire, Frigidaire Gallery 30' Double Electric Wall Oven with Air Fry, Retrieved from: https://www.frigidaire.com/Kitchen-Appliances/Wall-Ovens/Double/FGET3069UF/, Jun. 2021.
Canada Newswire, GE Appliances Canada Introduces New Wall Oven with Industry-First Air Fryer Technology, Dialog Solutions, ProQuest LLC, Jul. 3, 2019.
KitchenAid, 30-in Self Cleaning Double Electric Wall Oven with Even-Heat True Convection, Lowes, Retrieved from: https://www.lowes.com/pd/KitchenAid-Self-Cleaning-Single-Fan-European-Element-Double-Electric-Wall-Oven-Stainless-Steel-Common-30-Inch-Actual-30-, Jun. 2021.
Roberts, Shane, Breville Smart Oven Air: The Best Toaster Oven Is Now An Air Dryer and Dehydrator, Commerce Content, May 3, 2017.
Cuisinart, Air Fryer Toaster Oven, Wayfair, Retrieved from: https://www.wayfair.com/kitchen-tabletop/pdp/cuisinart-air-fryer-toaster-oven-cui3490.html , Retrieved on Oct. 18, 2018.
Electrolux, air-o-convect Electric Hybrid Convection Oven 201, Electrolux Professional, Retrieved from : http://tools.professional.electrolux.com/Mirror/Doc/MAD2/Electrolux/English%20Asia/Electric%20Convection%20Oven%20201_269204-269224.pdf, Feb. 25, 2016.

* cited by examiner

DOUBLE OVEN WITH TOASTER AND AIR FRYER

CROSS-REFERENCE TO RELATED APPLICATIONS

None

BACKGROUND

Consumer kitchen ovens provide an enclosed cavity with a heat source that enables food to be heated inside the oven cavity. Such ovens can be stand-alone appliances, or can be built into a wall or cabinetry. Stand-alone ovens often include a stovetop located above the oven, which is a generally horizontal surface on which food can be cooked (fried, boiled, steamed, seared, etc.). Built-in range ovens typically do not include a cooktop. In either the stand-alone embodiments or in the built-in embodiments, it has become common for ranges to include a double-oven, including an upper oven and a lower oven. These ovens can be gas or electric, and in either case can include a radiant heat source and/or a convection heat source. Often at least one of these ovens includes a broil capacity. Similarly, often each oven is self-cleaning, meaning it can achieve temperatures above approximately 790 degrees Fahrenheit for gas ovens and above approximately 850 degrees Fahrenheit for electric ovens. Self-cleaning ovens, because they must achieve higher temperatures than those needed for baking, are therefore typically more expensive than ovens that are not self-cleaning. Consumers prefer double ovens for the convenience of having two ovens, and generally speaking, the upper ovens are used more often due to their smaller size, which is helpful for smaller items and for reheating food quickly.

Consumers frequently purchase additional small appliances to be used in their kitchens for more specific, single-use cooking tasks. Two such appliances are toaster-ovens and air fryers. Toaster-ovens are small appliances that take up space on a counter top, and include a resistive heat element. This heat element typically gets red-hot and, due to its close proximity to the food load inside the toaster-oven, crisps or toasts the food via radiant heat transfer. Air fryers have become popular in recent years, and are similarly a single-use type of cooking appliance that takes up space on a counter top. As explained more fully in one of applicant's previously filed patent applications, U.S. patent application Ser. No. 17/091,532, entitled "Easy to Store Air Fryer", in air fryers, food is typically placed in or on a small food basket or pull-out tray. A radiant heating element within the air fryer heats the air inside the air fryer, and a fan directs a stream of air onto the food load. The fan in an air fryer performs differently than the fan in a standard convection oven. In a convection oven, the fan circulates air generally without being targeted to any particular area. In an air fryer, the fan moves the air much more rapidly, and does so in a targeted fashion directed at the food load. The air flow more completely contacts the food surfaces, removes moisture therefrom, and results in a crisp, fried-liked crust or surface.

Accordingly, a need exists in the art to provide a double oven in which one of the ovens is also a toaster-oven and an air fryer to eliminate the need, expense, and waste of counter space for consumers to purchase separate toaster-oven appliances and air fryers. Additional benefits obtain by providing a gas range with a double oven in which one of the ovens is a gas oven and the second oven is an electric oven, as well as providing a double oven that is more cost-effective than traditional double ovens as a result of providing an upper oven that is not self-cleaning.

SUMMARY

The herein-described embodiments address these and other problems associated with the art by providing a double oven in which one oven is configured to be both a toaster-oven and an air fryer. The double oven is a stand-alone kitchen appliance that replaces the traditional full-size range/stovetop and eliminates the need for additional small appliance toaster-ovens and air fryers.

An embodiment includes a cooking appliance comprising a cooktop including at least one cooking element within or beneath a surface for receiving a cooking vessel; and a double oven beneath the cooktop. The double oven includes a first oven and a second oven. The first oven is powered by a first power source and has a first heat source, and includes a baking mode of operation at a range of temperatures common for baking, for example between approximately 100 degrees Fahrenheit and approximately 550 degrees Fahrenheit. The first oven is a self-cleaning oven having a self-cleaning mode of operation at a range of temperatures greater than said range of baking temperatures and less than approximately 900 degrees Fahrenheit. The second oven further comprises a combined toaster-oven and air fryer cavity, with the cavity having a rear side, a left side, a right side, a bottom, and a top. The second oven is powered by a second power source and has a second heat source. The second power source and the second heat source is electricity. The second heat source includes a plurality of bake elements and a plurality of broil elements that can be various designs, including but not limited to graphite, quartz, and exposed nichrome wire. The second oven further comprises a fan configured to provide targeted air flow directly onto a food load that is placed inside the second oven.

An embodiment includes a cooking appliance comprising a cooktop including at least one cooking element within or beneath a surface for receiving a cooking vessel; and a double oven beneath the cooktop. The double oven includes a first oven and a second oven. The first oven is a self-cleaning oven and is located below the second oven. The first oven is powered by a first power source and has a first heat source configured to heat a plurality of bake elements and a plurality of broil elements. The first oven includes a convection fan. The second oven further comprises a combined toaster-oven and air fryer cavity having a rear side, a left side, a right side, a bottom, and a top. The second oven is powered by a second power source and has a second heat source. The second power source and second heat source is electricity. The second heat source includes a plurality of graphite bake heating elements and a plurality of graphite broil elements. The second oven further comprises a fan located at the rear side and configured to provide targeted air flow directly onto a food load that is placed inside the second oven.

An example method for air frying within a double oven is also provide. In a double oven range that includes a cooktop, a first oven having a first width, and a second oven having a second width, the second oven includes a fan, a plurality of bake elements, and a plurality of broil elements, and a control panel. In such a double oven, a method for air frying food comprises the steps of: inputting a desired selection via the control panel; alternately activating and deactivating the plurality of bake elements and the plurality of broil elements for a predetermined amount of time; repeating the activating and deactivating sequence for the entirety of a duration of a desired air frying activity; and operating the fan during the entirety of the air frying activity.

These and other advantages and features, which characterize the invention, are set forth in the claims annexed hereto. For a better understanding of the invention, and of the advantages and objectives attained through its use, reference should be made to the Drawings, and to the accompanying descriptive matter, in which there is described example embodiments of the invention. This summary is merely provided to introduce a selection of concepts that are further described below in the detailed description, and is not intended to identify key or essential features of the claimed subject matter, nor is it intended to be used as an aid in limiting the scope of the claimed subject matter.

BRIEF DESCRIPTION OF THE DRAWINGS

In the drawings, like reference characters generally refer to the same parts throughout the different views. The drawings are not necessarily to scale, emphasis instead generally being placed upon illustrating the principles of the invention.

DETAILED DESCRIPTION

The invention is not limited to the embodiments shown and described herein. Rather, the invention is to be limited only by the claims appended hereto. However, various embodiments have been selected to be discussed herein to illustrate exemplary, non-limiting implementations of the inventive concepts. The embodiments discussed hereinafter are directed in part to a double oven wherein one oven additionally provides toaster-oven and air fryer functions.

Figure 1:
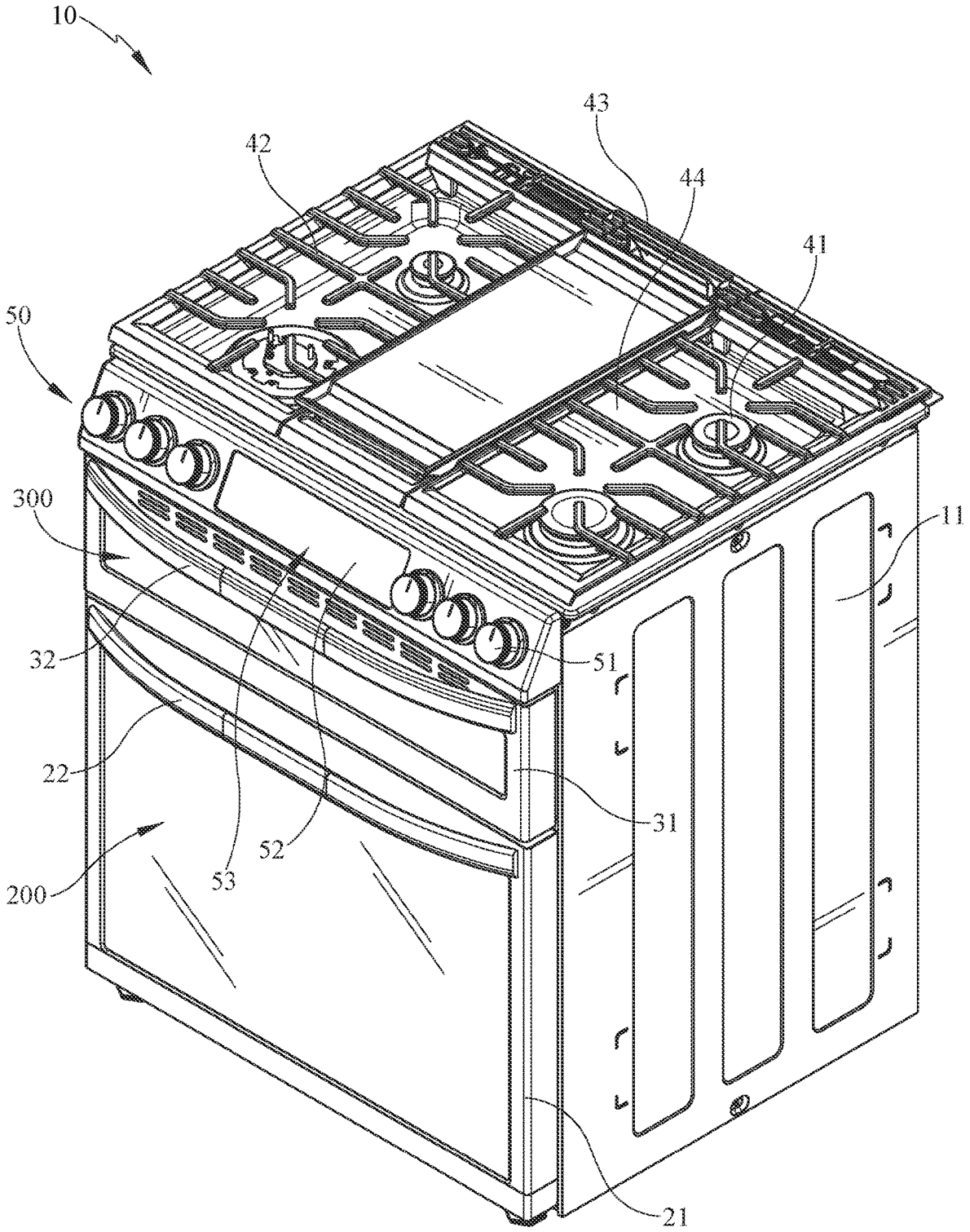
FIG. 1 is a perspective view of an appliance according to one embodiment.

Turning now to the figures, FIG. 1 illustrates an example appliance 10 in which various of the relevant structures, systems, and methods are implemented. The appliance 10 is depicted as a stand-alone consumer range having a cooktop 40 and a double oven in the form of a first oven 200 and a second oven 300. The cooktop 40 can be any of the many known types, sizes, and varieties of cooktops, and generally includes one or more cooking elements 41 arranged on or as part of or beneath the surface of the cooktop 40. In gas appliances, the cooking elements 41 are heated by gas that is supplied to the appliance 10 (e.g., natural gas, propane, LP, and so forth). In electric appliances, the cooking elements 41 are heated by various implementations of electricity (e.g., electric coil elements (either above or below a surface), radiant smooth elements, induction, and so forth). In the embodiment shown in FIG. 1, the cooktop 40 is a gas cooktop and includes a grate 42 that sits above the cooking elements 41 so as to provide a surface on which the cookware is placed. The cooking elements 41 pass through a drip tray 44. The appliance 10 also includes a vent 43 to allow heat from the ovens therebelow to escape. The appliance 10 could include one or more vents such as vent 43 for each oven included in the appliance 10. The appliance 10 could also, or alternatively, include openings for natural or forced cooling air exhaust if desired.

The appliance 10 also typically includes some form and variation of a control panel 50 to allow the user to control the cooking and baking functions of the appliance 10. In the embodiment shown, the control panel 50 includes one or more knobs 51 and a display or user interface 52. As is known, the control panel 50 could also be located elsewhere, such as on a backsplash or rear portion of the appliance 10. The knobs 51 enables control of each cooking element 41. The user interface or display 52 provides visual feedback as to the activation state of various aspects of the cooking appliance 10. It will be appreciated that cooking appliance 10 may include various types of user controls in other embodiments, including various combinations of switches, buttons, knobs and/or sliders, typically disposed at the rear or front (or both) of the cooking appliance. Further, in some embodiments, one or more touch screens may be employed for interaction with a user. As such, in some embodiments, display 52 may be touch sensitive to receive user input in addition to displaying status information and/or otherwise interacting with a user.

Figure 2:
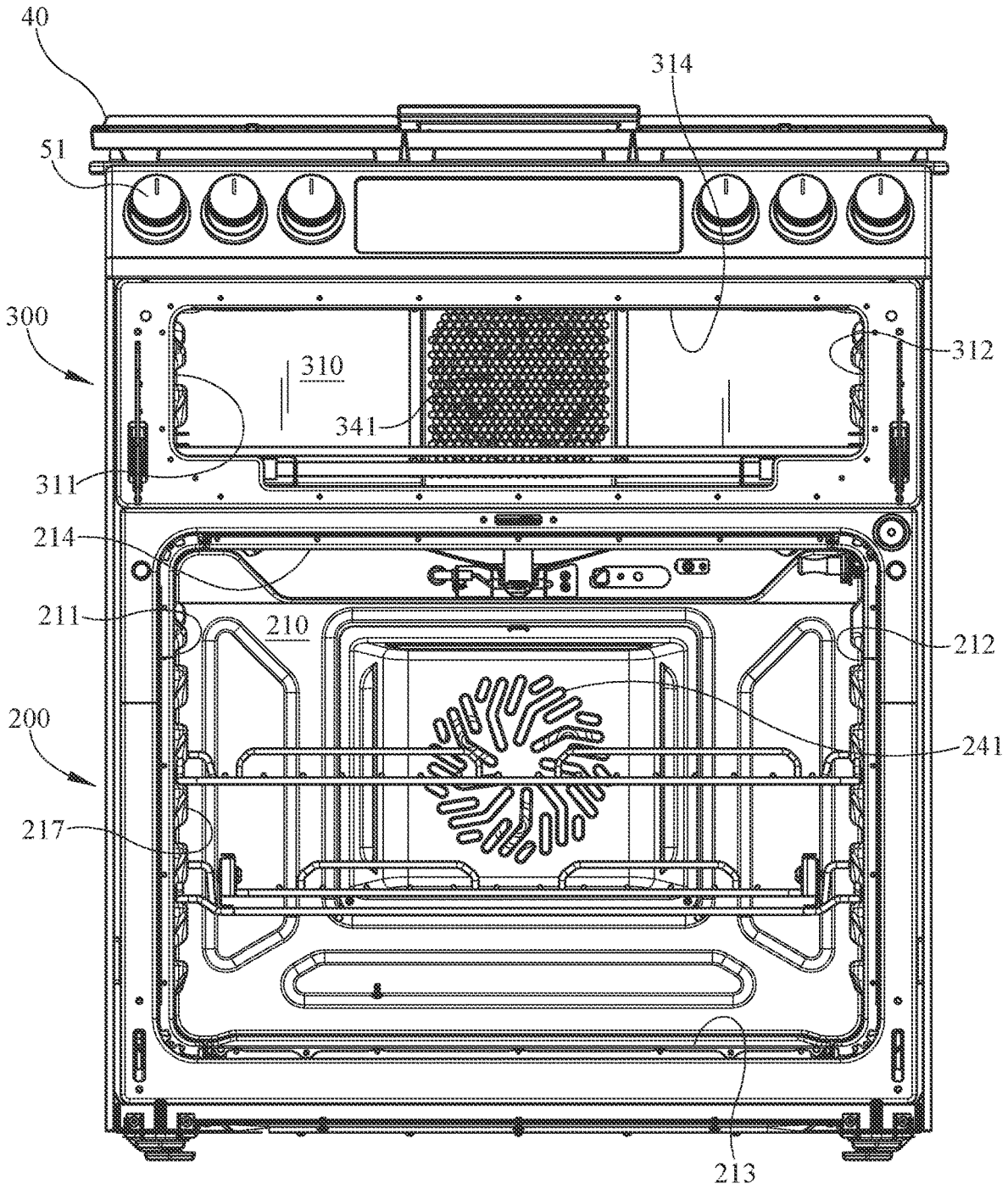
FIG. 2 is a front view of the appliance of FIG. 1.
Figure 3:
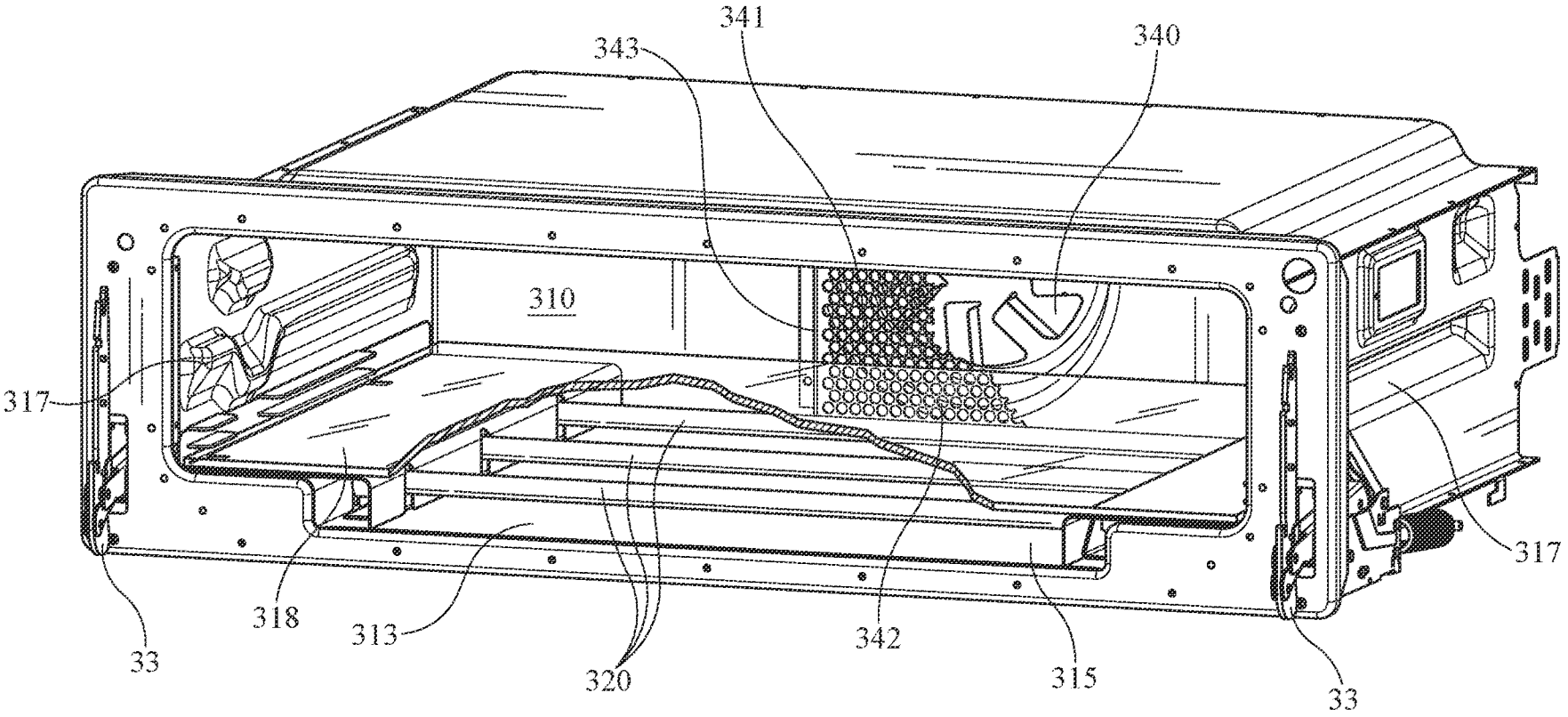
FIG. 3 is a upper front perspective view of the second oven portion of the appliance of FIG. 1 with the door and outer casing having been removed for clarity.

As referenced above, and with reference also to FIGS. 2 and 3, the appliance 10 depicted in FIG. 1 also includes a double oven in the form of first oven 200 and second oven 300. Generally, first oven 200 includes a first door 21 that is hingedly connected to the housing 11 (frame or body, etc.) of the appliance 10 via hinges 23 to allow access to the inside of the first oven 200. Also shown is a first handle 22 to facilitate opening and closing first door 21. First oven 200 includes a rear side 210, left side 211, right side 212, bottom 213, and top 214. One or more rack supports 217 are provided on left side 211 and right side 212 to provide support for one or more (typically) removable baking racks (not shown). Further, a reflective surface 215 can be employed, usually but not necessarily on the bottom 213, to direct and improve radiant heat transfer to the food load within the first oven 200. One or more reflectors 231 can also be included to radiant heat transfer to the food load within the first oven 200. Additional common oven accessories, such as a crumb tray 216 (not shown), various styles of baking racks, food trays, baskets, and the like can also be included.

The first oven 200 can be, as discussed above, of any type of oven commonly found in cooking appliances, including gas ranges and electric ranges. In typical ranges found in kitchens, there is a power source and a heat source. In electric ranges, the power source is electricity (typically 220-240V AC) and the heat source is also electricity (again, typically 220-240V AC). For electric ranges for home use, the 220-240V power source is typically installed on a dedicated 40 amp or 50 amp circuit, thus allowing much higher current for the bake elements, broil elements, and convection elements (e.g., 3800 Watt rating for bake elements; over 4000 Watt rating for broil elements; and 2000 Watt rating for convection elements are common ratings for electric ranges on 220-240V circuits) than is possible for standard 110-120V circuits, which is usually on a 15 amp circuit and limited to 1800 Watts of power. In gas ranges, the power source is also electricity, but is typically 110-120V AC, to power various items and features of the range (e.g., the control panel, the user interface, the lights, fans, igniters, and so forth). In gas ranges, the heat source is some form of gas, for example natural gas or various forms of liquefied petroleum products (e.g., propane, butane, and the like). Ordinarily, a range will be one of the types described above, namely, it is either an electric range (having an electric cooktop and one or more electric ovens) or a gas range (having a gas cooktop and one or more gas ovens). Also, in general terms, one or more of the ovens of common range can employ their heat source to heat the inside of the ovens. For example, such ovens can utilize radiant heat, convective heat, microwave radiation, and the like. The embodiments shown in the figures happen to show a gas range having a power source that is electricity, and having a gas cooktop 40, and including a double oven (first oven 200 and second oven 300), wherein first oven 200 has as its heat source natural gas. As will be described in further detail below, the embodiments of the invention enable the power source and the heat source for the second oven 300 to be electricity, enabling toaster capability and air-frying capability, as will be discussed.

With continuing reference to FIGS. 1 and 2, the first oven 200 typically includes one or more bake elements 220 and one or more broil elements 230. The bake elements 220 are located in or at the bottom 213, whereas the broil elements 230 are located in or at the top 214. As mentioned, although the heat source of the first oven 200 can be either electricity or gas, the figures depict an embodiment of a common oven wherein natural gas is the heat source. As such, the bake elements 220 and broil elements 230 include gas igniters and valves to provide controlled burning of the bake elements 220. The structures and controls involved in providing heat to the oven via the gas bake elements 220 and broil elements 230 are well known in the industry. Furthermore, the first oven 200, as discussed above, can be, among other types, radiant or convection. In embodiments where first oven 200 is a convection oven, a fan 240 is provided, typically on the rear side 210. Such fan 240 could be axial, radial, or centrifugal, as are commonly used in convection cooking appliances. The convection fan 240 includes a fan cover 241 that has front-facing air vents 242 and side-facing air vents 243. With respect to first oven 200, the fan 240 (if present at all) is a standard convection fan common in the industry. The fan 240 brings air into the front-facing air vents 242 and blows it out the side-facing air vents 243. General convection ovens such as first oven 200 typically utilize fans that blow at speeds of between 0 RPM and approximately 1500 RPM and typically operate intermittently (cycling on/off as needed) during a bake cycle.

With continuing reference to FIGS. 1-3, the appliance 10 double oven includes second oven 300. Generally, second oven 300 includes a second door 31 that is hingedly connected to the housing 11 (frame or body, etc.) of the appliance 10 via hinges 23 to allow access to the inside of the second oven 300. Also shown is a second handle 32 to facilitate opening and closing second door 31. Second oven 300 includes a rear side 310, left side 311, right side 312, bottom 313, and top 314. A rack support 317 is provided on left side 311 and right side 312 to provide support for a (typically) removable baking rack (not shown). Preferably, the baking racks useable for first oven 200 and second oven 300 are of the same size and can be interchangeable between first oven 200 and second oven 300.

Figure 4:
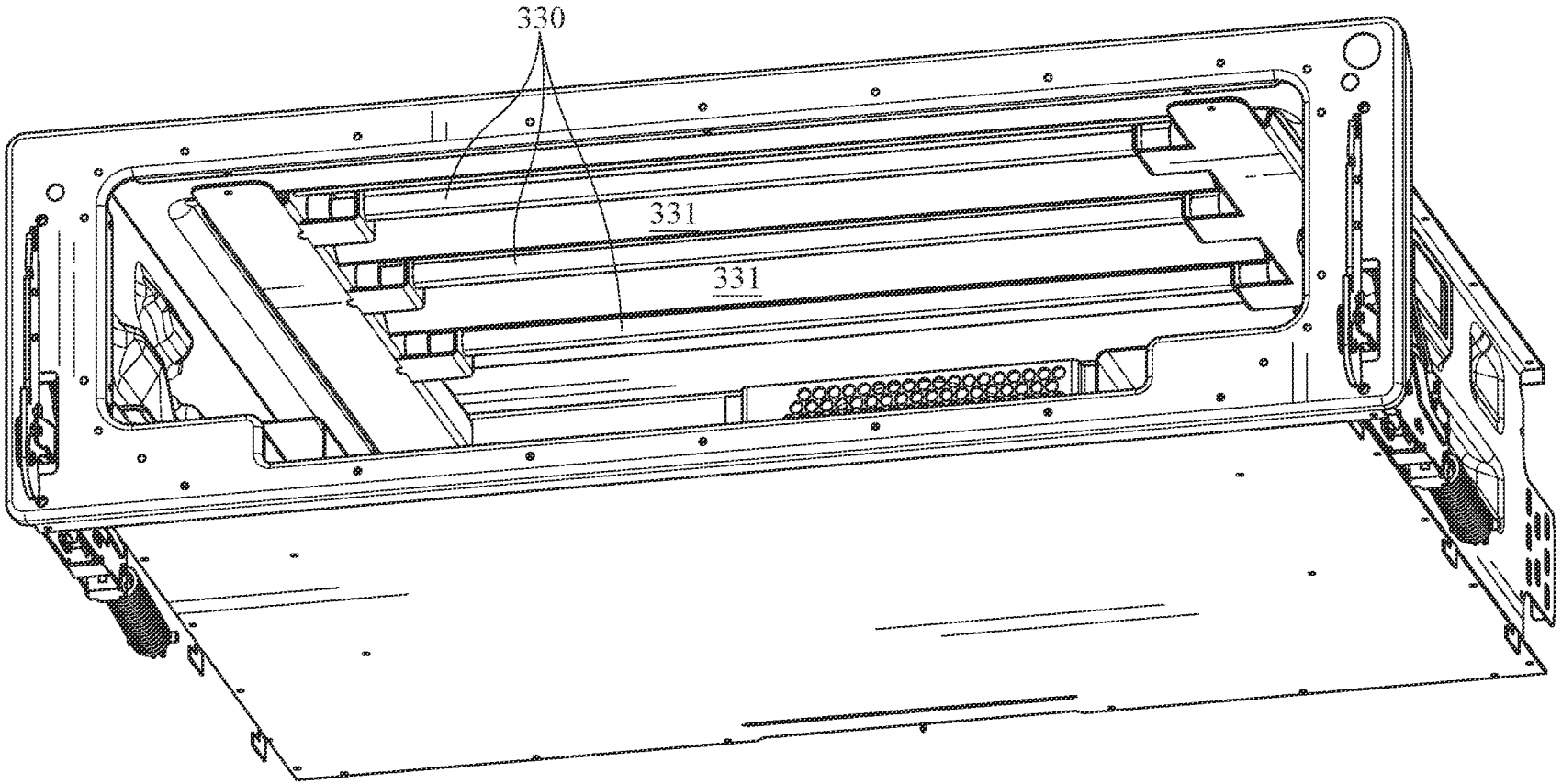
FIG. 4 is a lower front perspective view of the second oven portion of the appliance of FIG. 1 with the door and outer casing having been removed for clarity.

With reference to FIGS. 3 and 4, in the embodiment shown a fan 340 is located in approximately the middle of the rear side 310. The fan 340 can be of the same design and parameters as fan 240, or it can be of different design and parameters (e.g., size, style, blade design, speed of operation, and so forth) from that of fan 240. As will be described below, during air frying operation, the fan 340 is usually operated at speeds higher than typical convection fans, like fan 240. However, this is not always the case and is not required. The fan 340 includes a fan cover 341 that covers the blades of the fan 340. The fan cover 341 includes front-facing air vents 342 and side-facing air vents 343, which allow the fan 340 to move air therethrough. One or more (in the embodiment shown, a total of three is present) bake elements 320 is disposed at or near the bottom 313. In the appliance 10 of the figures, the bake elements 320 of the second oven 300 are electric elements, regardless whether the cooktop 40 is an electric cooktop or a gas cooktop, and regardless whether the bake elements of 220 of the first oven 200 are gas or electric. In this manner, the appliance 10 can be a combined gas/electric double oven.

Figure 8:
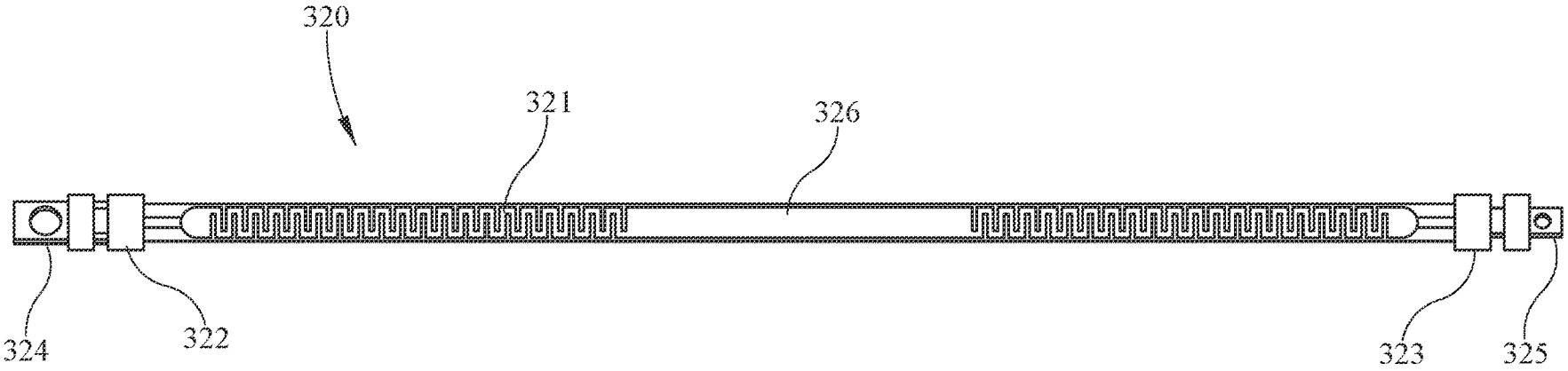
FIG. 8 is a top view of a bake element according to an embodiment of the appliance.

Various types of electric bake elements are known that heat by resistance, and example categories based on material type include, but are not limited to, metal or metal alloys (such as exposed nichrome wire), ceramic, quartz, polymer, and composite versions incorporating multiple materials (such as metal sheathed tubes (calrod) heating elements). Quartz elements, for example, offer faster heat up times and improve radiant heat transfer to the food load and are a preferred embodiment. As shown in FIG. 8, in the most preferred embodiment herein, the bake elements 320 are graphite bake elements having a graphite element 321 extending between two ends 322, 323 that each contain an electrical contact surface 324, 325, respectively. The electrical contact surfaces 324, 325 physically mate into complementary receptacles (not shown) within the second oven 300 that are electrically connected to the main source of electricity. The ends can also be electrical blade/spade connectors that connect directly to wires with the corresponding mating connector. The graphite elements 321 could be exposed, or they could be encased in a protective cover by a heat-resistant or heat conductive material, such as, for example, tempered glass, ceramic glass, aluminum sheeting, metal or metal alloy materials having holes or other openings therein to allow air to flow. Such covers could also be used to capture, divert, or otherwise prevent spills from directly contacting the graphite element. In the preferred embodiment shown, the graphite bake element 320 is contained within a tempered glass cover 326. The graphite bake element 320, such as are manufactured by Midea, enable full heat-up time from zero to approximately 2300 degrees Fahrenheit measured at the surface of the element in less than about one second. This performance is many times faster than standard heat elements, and also several times faster even than quartz elements.

A reflective surface 315 is preferably also included inside the second oven 300, and typically resides below the bake elements 320 on or at the bottom 313. The reflective surface 315 serves to reflect heat from the bake elements 320 to direct and improve radiant heat transfer to food placed inside the second oven 300. Alternatively, or in addition, as shown in FIG. 3, a tray 318 can be included to act as a cover or spill tray, or as a cooking surface, to provide additional protective/aesthetic surface for the bake elements 320. Tray 318 can be of any materials commonly acceptable within ovens, including, but not limited to, tempered glass, ceramic glass, aluminum, or other metal or metal alloy.

Additionally, with reference primarily to FIGS. 3 and 4, one or more (in the embodiment shown, a total of three is present) broil elements 330 is disposed at or near the top 314. Preferably, the second oven 330 also includes a reflector 331 between the broil elements 330 and the top 314 to direct and improve radiant heat transfer to the food load below the broil elements. In the appliance 10 of the figures, the broil elements 330 of the second oven 300 are, as with the bake elements 320, electric elements, regardless whether the cooktop 40 is an electric cooktop or a gas cooktop, and regardless whether the bake elements of 220 of the first oven 200 are gas or electric. In this manner, the appliance 10 can be a combined gas/electric double oven.

The broil elements 330 of the second oven 300 can be, but need not be, the same as the bake elements 320. However, in the preferred embodiment, the broil elements 330 are of the same design as the bake elements 320. Therefore, for purposes of understanding the broil elements 330, reference is made back to the discussion of the bake elements 320 above. Relatedly, FIG. 8 can be viewed as being equally applicable to the broil elements 330. In short, the preferred broil elements 330 are graphite broil elements 330 contained within a tempered glass cover.

Figure 5B:
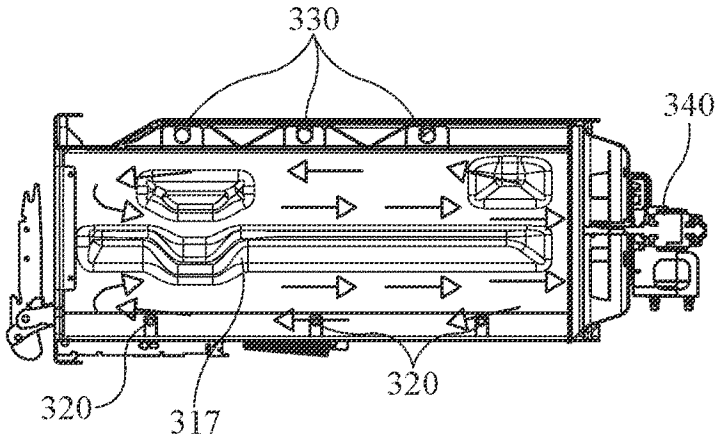
FIG. 5B is a side view of the appliance of FIG. 5A.
Figure 5A:
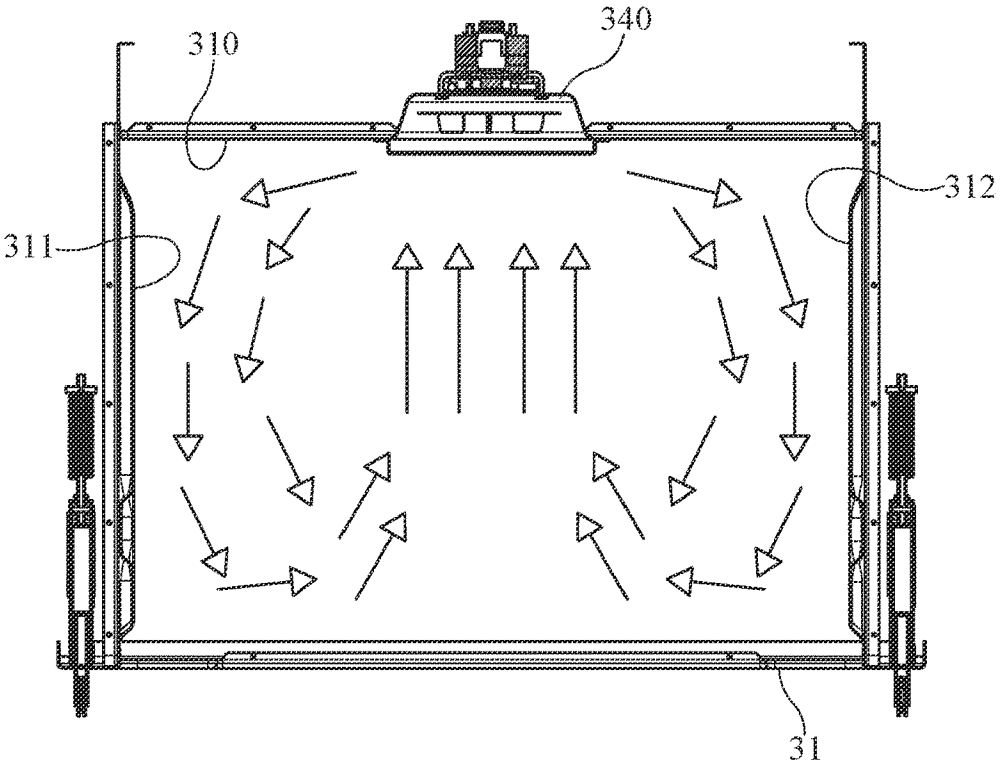
FIG. 5A is a top view into the second oven portion of the appliance of FIG. 1 depicting a simplified air path within the oven.
Figure 6A:
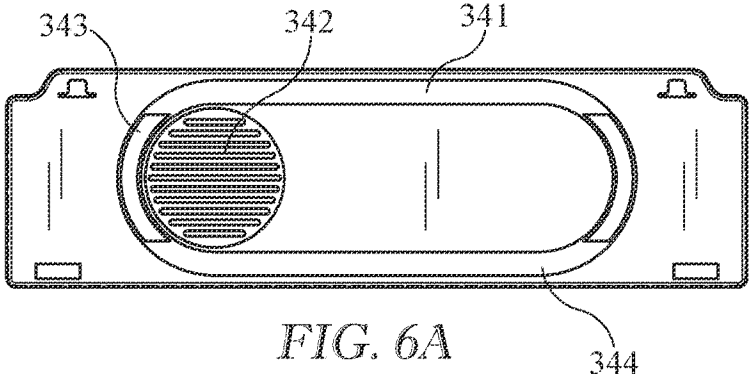
FIG. 6A is a front perspective view of an alternative embodiment for a fan and fan vent for the rear of an appliance.
Figure 7A:
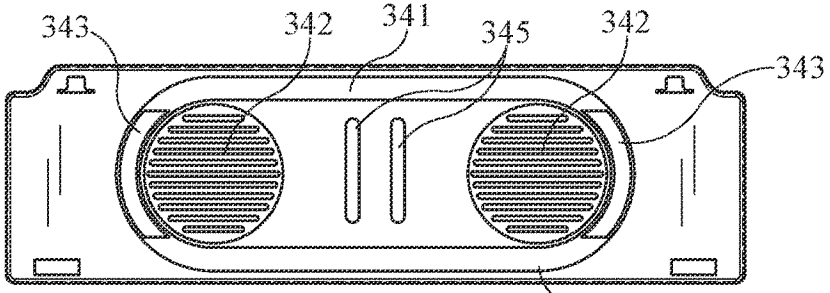
FIG. 7A is a front perspective view of a further alternative embodiment for a fan and fan vent for the rear of an appliance.

With reference now to FIGS. 5A-5B, the function of the fan 340 will be described. FIG. 5A shows a top view of the inside of the second oven 300. In the embodiment shown, the fan 340 is situated on the rear side 310 of the second oven 300, approximately in the middle. When activated, the fan 340 draws air into the front-facing air vents 342 of the fan cover 341 (that is, toward the rear side 310). The open arrows in FIG. 5A schematically show the air movement within the second oven 300 as a result of the fan 340. The fan 340 pulls air toward itself through the front-facing air vents 342, and the air then exits the fan cover 341 through the side-facing air vents 343. These side-facing air vents 343 can be located anywhere around the front-facing air vents 342, for example on the top or on the bottom, but are preferably as shown in FIGS. 6A and 7A. This results in the exiting air to be directed horizontally toward the left side 311 and the right side 312. The air then moves along the left side 311 and right side 312 until impacting the second door 31, where it enters into the stream of air moving toward the fan 340. Thus, a convection current is established within the second oven 300, and the air flow is targeted at the food load that is present in the central region of the second oven 300, sitting on an oven rack.

FIG. 5B is a side view of the inside of the second oven 300 showing the height component of the convention current caused by the fan 340. The open arrows in FIG. 5B show that the fan 340 draws air into itself from the front, and that air exits the fan 340 along the bottom 313 and top 314 of the second oven 300. The fan 340 is an electric fan that operates over a range of revolutions per minute that can be, theoretically, anywhere from zero to 5000. However, the more appropriate range would be from about 500 rpm to about 3000 rpm, and the preferable range for air frying is in the range of between about 1500 rpm to about 2500 rpm.

FIG. 6A is a perspective view of an alternative embodiment of the fan 340 and fan cover 341. This embodiment places the fan 340 on the rear side 310 closer to the left side 311. The fan cover 341 includes an elongated boss 344 that provides more separation between the side-facing air vents 343. The fan 340 of this embodiment operates in the same fashion as the fan 340 of the first embodiment. The fan cover 341 of this embodiment operates in the same fashion as the fan cover 341 of the first embodiment. However, because of the position of the fan 340 and the shape of the fan cover 341 of this embodiment, the air flow within second oven 300 is different from that of the first embodiment.

Figure 6C:
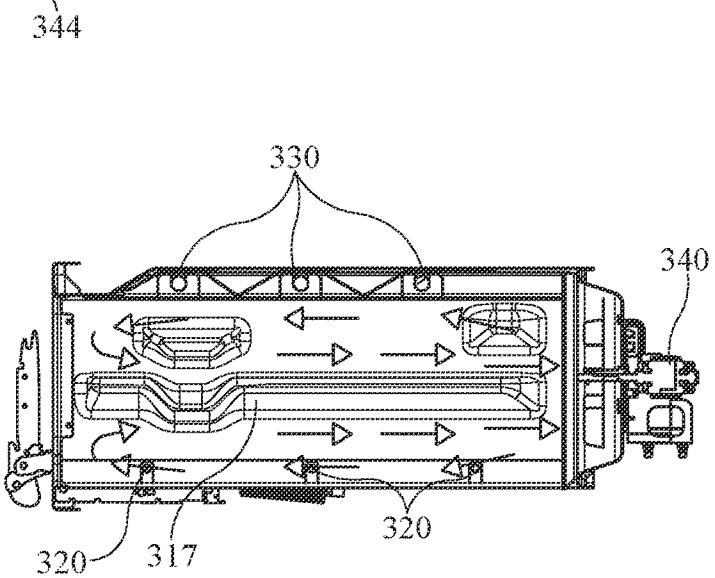
FIG. 6C is a side view of the appliance portion of FIG. 6B.
Figure 6B:
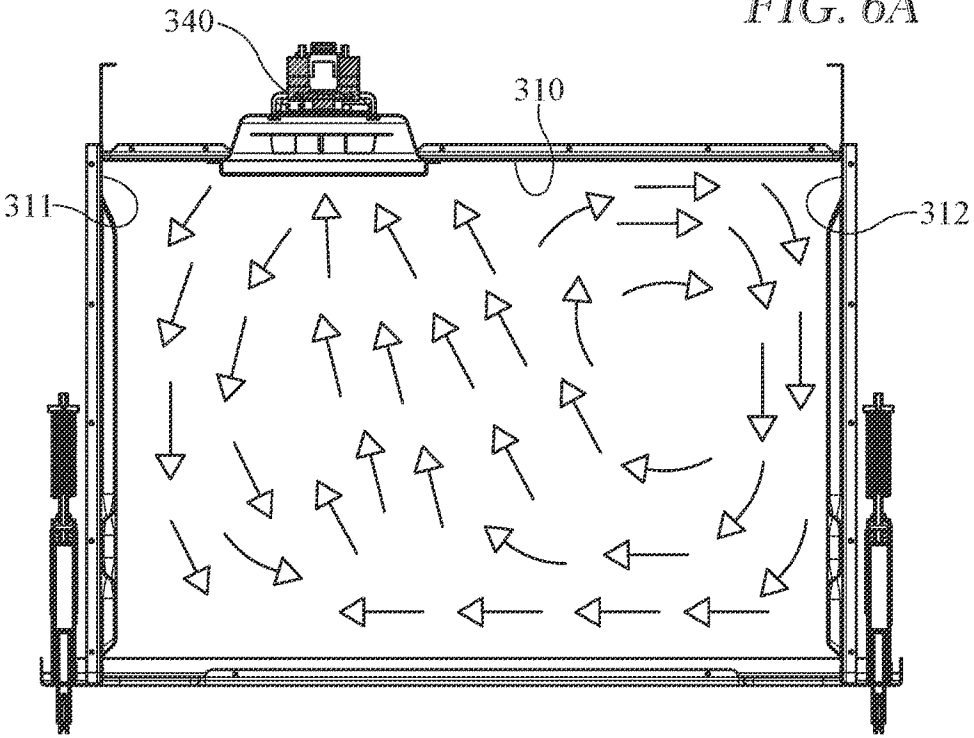
FIG. 6B is a top view into the second oven portion of the appliance using the fan and fan vent of FIG. 6A depicting a simplified air path within the oven.

FIG. 6B shows a top view of the inside of the second oven 300 of this alternative embodiment. The open arrows in FIG. 6B schematically show the air movement within the second oven 300 of this embodiment as a result of the fan 340. When activated, the fan 340 draws air into the front-facing air vents 342 of the fan cover 341 (that is, toward the rear side 310). The fan 340 pulls air toward itself through the front-facing air vents 342, and the air then exits the fan cover 341 through the side-facing air vents 343. Because the fan 340 is situated closer to the left side 311, and because of the extended distance between the side-facing air vents 343, this results in the convection current being skewed more toward the left side 311, as shown in FIG. 6B. The air then moves along the left side 311 and right side 312 until impacting the second door 31, where it enters into the stream of air moving toward the fan 340. Thus, the convection current established within the second oven 300 still targets the air flow at the food load that is present in the central region of the second oven 300, sitting on an oven rack, but the air flow impacts the food load at an acute angle with respect to a normal axis extending from the rear side 310 (as opposed to a substantially zero angle with respect to a normal axis extending from the rear side 310 in the first embodiment).

FIG. 6C is a side view of the inside of the second oven 300 of this alternative embodiment showing the height component of the convention current caused by the fan 340. The open arrows in FIG. 6C show that the fan 340 draws air in from the front-facing air vents 342, and that air exits the fan 340 at various elevations through the side-facing air vents 343 along the bottom 313 and top 314 of the second oven 300. The fan 340 of this embodiment is also an electric fan that operates over a range of revolutions per minute as described above with respect to the first embodiment.

FIG. 7A is a perspective view of a further alternative embodiment of the fan 340 and fan cover 341. This embodiment includes two fans 340 on the rear side 310. The fan cover 341 includes an elongated boss 344 that provides separation between the front-facing air vents 342 covering each of the two fans 340. The fans 340 of this embodiment operate in the same fashion as the fan 340 of the first embodiment. The fan cover 341 of this embodiment operates in a similar fashion as the fan cover 341 of the first embodiment. However, because there are two fans 340, the air flow within second oven 300 is different from that of the first and second embodiments. Also, the fan cover 341 of this embodiment preferably further includes central air vents 345 for air to flow away from the fans 340 as discussed below.

Figure 7C:
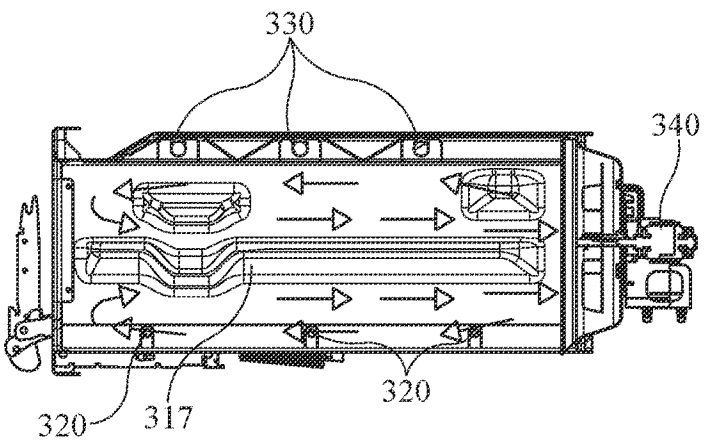
FIG. 7C is a side view of the appliance portion of FIG. 7B.
Figure 7B:
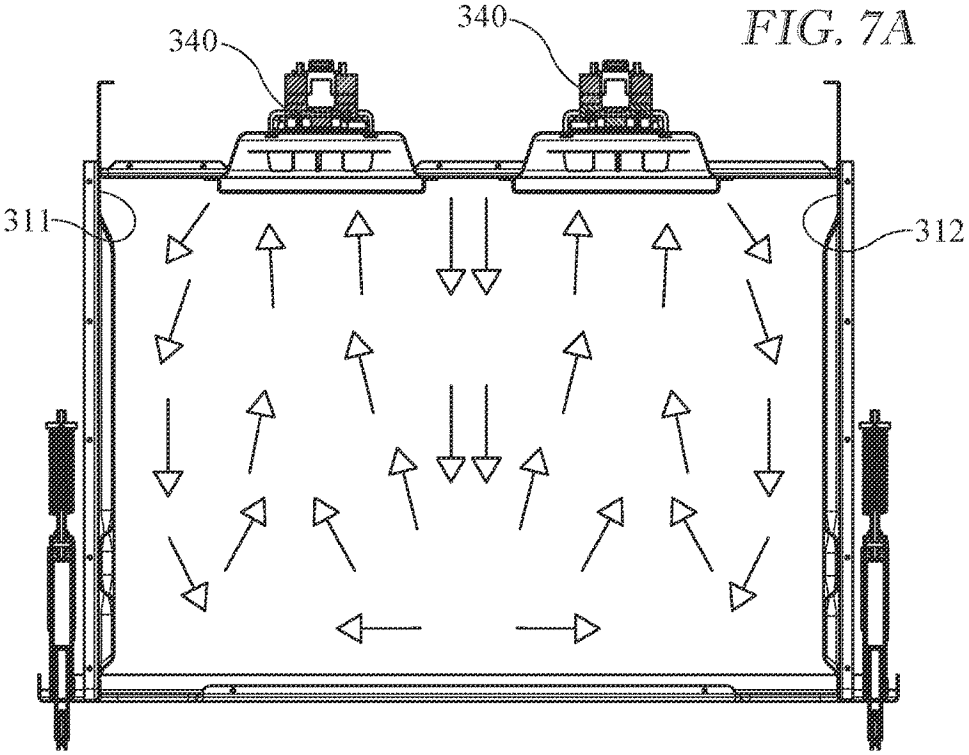
FIG. 7B is a top view into the second oven portion of the appliance using the fan and fan vent of FIG. 7A depicting a simplified air path within the oven.

FIG. 7B shows a top view of the inside of the second oven 300 of this alternative embodiment. The open arrows in FIG. 7B schematically show the air movement within the second oven 300 of this embodiment as a result of the two fans 340.

When activated, the fans 340 draw air into the front-facing air vents 342 of the fan cover 341 (that is, toward the rear side 310). The fans 340 pull air through the front-facing air vents 342, and the air then exits the fan cover 341 through the side-facing air vents 343 and, if present, the central air vents 345. Because there are two fans 340, the convection current includes two generally rotating streams of air, as shown in FIG. 6B. The air then moves away from the fans 340 along the left side 311, right side 312, and centrally away from the central air vents 345 until impacting the second door 31, where the air enters into the two streams of air moving toward the fans 340. Thus, the convection current established within the second oven 300 still targets the air flow at the food load that is present in the central region of the second oven 300, sitting on an oven rack, but the air flow impacts the food load in two air currents, each rotating oppositely from the other.

FIG. 7C is a side view of the inside of the second oven 300 of this further alternative embodiment showing the height component of the convention current caused by the two fans 340. The open arrows in FIG. 7C show that the fans 340 draw air in from the front-facing air vents 342, and that air exits the fans 340 at various elevations through the side-facing air vents 343 along the bottom 313 and top 314 of the second oven 300 and also through the central air vents 345. The fans 340 of this embodiment are also electric fans that operate over a range of revolutions per minute as described above with respect to the first embodiment.

Additionally, the one or more fans 340 need not be positioned at the rear 310. If space permits, the fan 340 can be located at the top 314 of the second oven 300, and similarly designed to pull air in through the front-facing air vents 342 and expel air out of the side-facing air vents 343. Also, although perhaps more costly, one or more fans 340 can be located on either the left side 311 or the right side 312, or both. Each such fan 340, again, would pull air in through the front-facing air vents 342 and expel air out of the side-facing air vents 343. In such two-fan side location embodiments, to achieve different convection currents within the second oven 300, it is also possible to locate one fan 340 on the left side 311 closer to the rear side 310, while locating another fan 340 on the right side 312 closer to the second door 31, and vice versa.

In the figures, the second oven 300 is depicted as preferably being located above the first oven 200; however, this is not required. The second oven 300 could be located below the first oven 200, specifically where the normal bottom drawer would otherwise be in, for example, a single oven range. In such embodiments, all of the structures and features described above would be equally applicable to the respective first oven 200 and second oven 300, with only the physical locations of the first oven 200 and second oven 300 being altered. Regardless of whether the second oven is located above or below the first oven 200, one of the many benefits of a range according to the embodiments of the invention described herein is that the second oven 300 is a combination toaster and air fryer that is permanently built into the range and not a separate appliance. A further benefit of this novel arrangement is that the second oven 300 has the same internal width (distance from left side 311 to right side 312) as the first oven width (distance from left side 211 to right side 212). This provides the user with a larger toaster and air fryer than would be the case for stand-alone countertop toasters or air fryers.

In use, the range can operate in a variety of manners which include all the same manner as common ranges. That is, as discussed above, the cooktop 40 can be electric or gas, of any common varieties. It can be operated by a user operating the cooktop 40 via the control panel 50 to perform all the functions normally possible in cooktops (heating, simmering, boiling, frying, steaming, and so forth). Similarly, the first oven 200 and second oven 300 can be, as discussed above, electric or gas. Additionally, first oven 200 can be electric or gas, while second oven 300 is electric. First oven 200 can be radiant, convection, microwave, or any combination of these or other types of ovens. Second oven 300 is preferably electric to provide the toaster and air frying capabilities. Second oven 300 could alternatively be a combination of a gas bake element (akin to bake elements 220 described above) with an electric broil element 330.

The manner of operation, and the control inputs and control algorithms used in and employed by the user inputs into the control panel 50, if any, used for the cooktop 40 and for the first oven 200 and second oven 300 include the commonly known and used methods and structures for controlling typical ranges. Examples include heat level control, burner activation and de-activation, timed cook, delayed start-time, visual indicators of various parameters, audible indicators of various parameters, auto shut-off, preheat, and so forth. Additionally, because second oven 300 is a combination toaster and air fryer, its controls include features not present in typical ranges. The control panel 50 includes input methods such as knobs 51 as one example, but others include buttons, sliders, touchpads, and other physical inputs, as well as non-physical inputs, such as Bluetooth or other wireless activated controls, voice commands, and the like.

Figure 9:
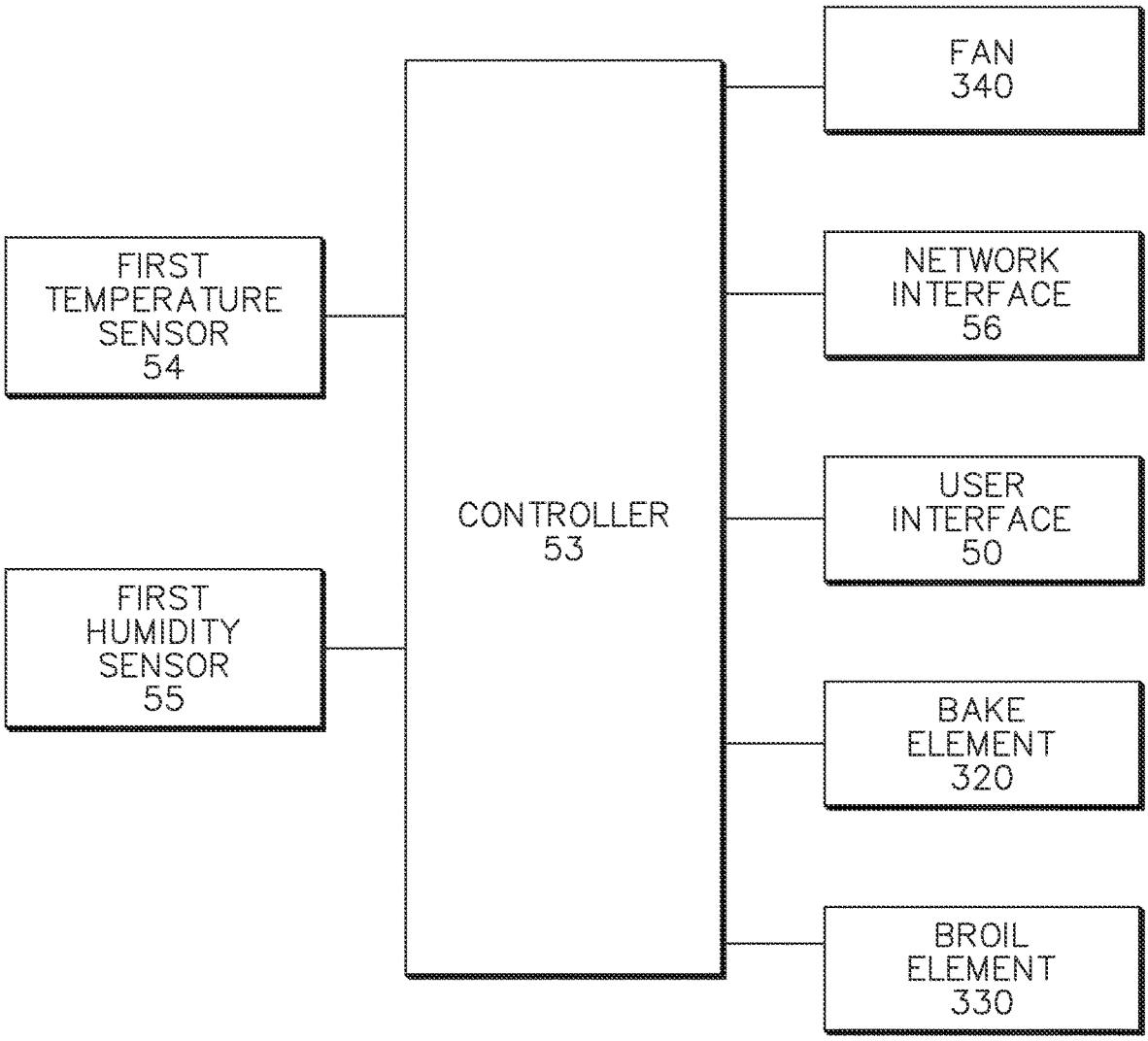
FIG. 9 is a schematic of a representative control system for an appliance such as shown in FIG. 1, according to an embodiment.

In some implementations as shown in the figures, cooking appliance 10 includes a control panel 50 connected to a controller 53 (shown schematically in FIG. 9). The controller 53 receives inputs from a number of components and drives a number of components in response thereto. Controller 53 may, for example, include one or more processors and a memory (not shown) within which may be stored program code for execution by the one or more processors. The memory may be embedded in the controller, but may also be considered to include volatile and/or non-volatile memories, cache memories, flash memories, programmable read-only memories, read-only memories, etc., as well as memory storage physically located elsewhere from controller, e.g., in a mass storage device or on a remote computer interfaced with controller.

The controller 53 may be interfaced with various components of the cooking appliance 10, to control one or more heat cycles, air frying cycles, and/or one or more toaster cycles to cook food contents in the second oven 300, and one or more heat cycles in the first oven 200. In particular, with respect to the second oven 300, the controller 53 may be interfaced with the bake elements 320, the broil elements 330, and the fan 340. In some implementations, the bake elements 320 and/or broil elements 330 may be activated, separately, together, or in sequences, to provide the desired type and amount of heat to the second oven 300 during at least a portion of the bake cycle, for a first time period. The fan 340 may direct air directly onto the food load inside the second oven for a second time period during at least a portion of the one or more air frying cycles and/or toasting cycles. Similarly, with respect to the first oven 200, the bake elements 220 and/or broil elements 230 may be activated to bake, heat, or broil the food contents within the first oven 200 for a third time period during at least a portion of the one or bake cycles of the first oven 200. In various embodiments, the functioning of the first oven 200 and the second oven 300 are independent of each other.

In some embodiments, a portion of the first time period and a portion of the second time period may overlap. In various embodiments, the first and second time periods may not overlap. In some implementations, the bake elements 320 and the broil elements 330 may radiate heat or heat the food at the same, different, or overlapping time period(s), or portion of the timer period, to cook the respective food in the second oven 300 as desired. As a non-limiting example, the air frying cycle and/or toasting cycle of the second oven 300 may overlap at least partially in time with the bake cycle thereof. The user may toast food separate from baking. The user may air fry food separate from baking. The user may toast food separate from air frying. The user may elect to not toast or air fry at all, choosing instead to only bake food within second oven 300.

Again, with respect to second oven 300, the controller 53 may be coupled to the bake elements 320, the broil elements 330, and the fan 340 to initiate, perform, and cease the user's desired cooking activities within the second oven 300 (including, for example, baking, re-heating, broiling, toasting, air frying, and the like). The controller 53 may activate and execute the desired baking for the bake cycle or broil cycle for the one or more first time periods. The controller 53 may additionally activate the fan 340, for the one or more second time periods, to perform air frying. It should be understood that the fan 340 may operate at one or more time intervals before, during, and/or after the bake elements 320 and/or broil elements 330 are activated in a variety of air fryer cycles and toaster cycles. The controller 53 may control the bake elements 320 and/or broil elements 330 to activate/deactivate when the air is circulating and/or is not circulating during a cycle. The controller 53 can operate the second oven 300 in a manner of only baking, or only broiling, or only toasting, or only air frying, as desired by a user. The user can also alternate bake and broil functions. The user can also employ a combination of simultaneous activation of the bake elements 320 and the broil elements 330, for any duration of overlap. The user can also activate the fan 340 for all or only a portion of any given bake or broil or toaster cycle.

Optionally, as shown in FIG. 9, the controller 53 may be coupled to a first temperature sensor 54 and/or a first humidity sensor 55, to control and/or determine the temperature and/or humidity of the second oven 300 and/or food contents. If used, the temperature sensor 54 and the humidity sensor 55 may be used to determine the food/container and/or compartments temperature and/or humidity or verify when the food contents are cooked as desired (that is, baked, broiled, heated, toasted, and/or air fried).

Similarly, with regard to the first oven 200, the controller 53 may be coupled to the bake elements 220, broil elements 230, and fan 240 (if present) to heat, bake, or broil the food within the second oven 200 for one or more bake or broil cycles of the second oven 200. With respect to the first oven 200, which does not include the toaster or air fryer capabilities, such controls of the baking and/or broiling cycles are well known. As stated above, the first oven 200 is generally also a self-clean oven. Therefore, the controller 53 is also usable to activate, execute, and terminate the self-cleaning mode of the first oven 200, according to known techniques.

As discussed above, controller 53 may be coupled to a user interface or control panel 50, including various input/output devices such as knobs, dials, sliders, switches, buttons, lights, textual and/or graphics displays, touch screen displays, speakers, image capture devices, microphones, etc. for receiving input from and communicating with a user. In some embodiments, controller 53 may also be coupled to one or more network interfaces 56, e.g., for interfacing with external devices via wired and/or wireless networks such as Ethernet, Bluetooth, NFC, cellular and other suitable networks. Moreover, in some embodiments, at least a portion of controller 53 may be implemented externally from a cooking appliance, e.g., within a mobile device, a cloud computing environment, etc., such that at least a portion of the functionality described herein is implemented within the portion of the controller that is externally implemented. In some embodiments, controller may operate under the control of an operating system and may execute or otherwise rely upon various computer software applications, components, programs, objects, modules, data structures, etc. In addition, controller may also incorporate hardware logic to implement some or all of the functionality disclosed herein. Further, in some embodiments, the sequences of operations performed by controller 53 to implement the embodiments disclosed herein may be implemented using program code including one or more instructions that are resident at various times in various memory and storage devices, and that, when read and executed by one or more hardware-based processors, perform the operations embodying desired functionality. Moreover, in some embodiments, such program code may be distributed as a program product in a variety of forms, and that the concepts apply equally regardless of the particular type of computer readable media used to actually carry out the distribution, including, for example, non-transitory computer readable storage media. In addition, it will be appreciated that the various operations described herein may be combined, split, reordered, reversed, varied, omitted, parallelized and/or supplemented with other techniques known in the art, and therefore, the invention is not limited to the particular sequences of operations described herein.

The control sequence and durations can vary widely, and also can vary depending on the heat source (120V electric, 220V electric, gas, etc.), such that it is not necessary (or even possible) to try to list every conceivable control cycle for every type of use of the appliance 10. However, some non-limiting exemplary steps are discussed below for a better understanding of a sample use of second oven 300.

Depending on what a user desires to do (e.g., warm, thaw, re-heat, bake, broil, toast, air fry, etc.), the user selects a heat level from the control panel 50 (or in various ways via network interface 56). Obviously this heat level could be in any range common for the desired activity, but for purposes of description here, could be easily between approximately 100 degrees Fahrenheit and approximately 550 degrees Fahrenheit. The controller 53 then activates either or both of the bake elements 320 and broil elements 330 and the fan 340 in a manner dependent on desired outcome for the food. For an example simple baking, the controller 53 might activate the fan 340 at a given speed (e.g., 0 to 1500 RPM). The fan 340 might be operated during the entire bake cycle. Or, the fan 340 might be controlled to intermittently operate for given periods of time, separated by given periods of non-operation. In one sample method, the second oven 300 enters a period of preheat, for example for five minutes, wherein the bake elements 320 are energized to provide heat to the second oven 300. The controller 53 might then cycle the bake elements 320 and the broil elements 330 as follows: 21 seconds where only the bake elements 320 are active, followed by 8 seconds where the bake elements 320 are off, followed by 7 seconds where the broil elements 330 are active. This cycle could be repeated for the duration of the desired bake activity.

In one sample air frying method, the controller 53 might operate the fan 340 at full speed for the duration of the air frying, and might cycle the bake elements 320 and broil elements 330 as follows: 14 seconds where only the bake elements 320 are on, followed by 21 seconds where only the broil elements 330 are on, then repeat. In one sample broil method, the controller 53 might activate the broil elements 330 at all times, and not activate the fan 340 or the bake elements at all. In one sample toast method, only the broil elements 330 are active (that is, neither the fan 340 nor the bake elements 320), and the food is placed on a rack that is in the highest position inside the second oven 300. The food is then turned over half-way through the toasting. This same toasting cycle might not require turning the food if the second oven 300 is a 220V electric oven, as the extra power might permit toasting on both sides at the same time for shorter durations with the food in the middle rack position.

As alluded to above, these example methods and cycles are purely exemplary. The actual methods employed depend on many factors, including but not limited to, the power source; heat source; fan 340 type and size; fan 340 blade design; fan cover 341 design; number and type of heating elements 320; number and type of broil elements 330; internal surface design of the second oven 300; whether and what type of reflector 331 and/or reflective surface 315 exists; and so forth. Additionally, the second oven 300 can be electrically wired so as to be able to individually control each of the bake elements 320 and broil elements 330, so that any combination of activation of same can be achieved (e.g., all of one type on while some of a different type are on; some on; some of each type are on; some of only one type are on; etc.).

While several embodiments have been described and illustrated herein, those of ordinary skill in the art will readily envision a variety of other means and/or structures for performing the function and/or obtaining the results and/or one or more of the advantages described herein, and each of such variations and/or modifications is deemed to be within the scope of the embodiments described herein. More generally, those skilled in the art will readily appreciate that all parameters, dimensions, materials, and configurations described herein are meant to be exemplary and that the actual parameters, dimensions, materials, and/or configurations will depend upon the specific application or applications for which the teachings is/are used. Those skilled in the art will recognize, or be able to ascertain using no more than routine experimentation, many equivalents to the specific embodiments described herein. It is, therefore, to be understood that the foregoing embodiments are presented by way of example only and that, within the scope of the appended claims and equivalents thereto, embodiments may be practiced otherwise than as specifically described and claimed. Embodiments of the present disclosure are directed to each individual feature, system, article, material, and/or method described herein. In addition, any combination of two or more such features, systems, articles, materials, and/or methods, if such features, systems, articles, materials, and/or methods are not mutually inconsistent, is included within the scope of the present disclosure.

All definitions, as defined and used herein, should be understood to control over dictionary definitions, definitions in documents incorporated by reference, and/or ordinary meanings of the defined terms.

The indefinite articles "a" and "an," as used herein in the specification and in the claims, unless clearly indicated to the contrary, should be understood to mean "at least one."

The phrase "and/or," as used herein in the specification and in the claims, should be understood to mean "either or both" of the elements so conjoined, i.e., elements that are conjunctively present in some cases and disjunctively present in other cases. Multiple elements listed with "and/or" should be construed in the same fashion, i.e., "one or more" of the elements so conjoined. Other elements may optionally be present other than the elements specifically identified by the "and/or" clause, whether related or unrelated to those elements specifically identified. Thus, as a non-limiting example, a reference to "A and/or B", when used in conjunction with open-ended language such as "comprising" can refer, in one embodiment, to A only (optionally including elements other than B); in another embodiment, to B only (optionally including elements other than A); in yet another embodiment, to both A and B (optionally including other elements); etc.

As used herein in the specification and in the claims, "or" should be understood to have the same meaning as "and/or" as defined above. For example, when separating items in a list, "or" or "and/or" shall be interpreted as being inclusive, i.e., the inclusion of at least one, but also including more than one, of a number or list of elements, and, optionally, additional unlisted items. Only terms clearly indicated to the contrary, such as "only one of" or "exactly one of," or, when used in the claims, "consisting of," will refer to the inclusion of exactly one element of a number or list of elements. In general, the term "or" as used herein shall only be interpreted as indicating exclusive alternatives (i.e. "one or the other but not both") when preceded by terms of exclusivity, such as "either," "one of," "only one of," or "exactly one of" "Consisting essentially of," when used in the claims, shall have its ordinary meaning as used in the field of patent law.

As used herein in the specification and in the claims, the phrase "at least one," in reference to a list of one or more elements, should be understood to mean at least one element selected from any one or more of the elements in the list of elements, but not necessarily including at least one of each and every element specifically listed within the list of elements and not excluding any combinations of elements in the list of elements. This definition also allows that elements may optionally be present other than the elements specifically identified within the list of elements to which the phrase "at least one" refers, whether related or unrelated to those elements specifically identified. Thus, as a non-limiting example, "at least one of A and B" (or, equivalently, "at least one of A or B," or, equivalently "at least one of A and/or B") can refer, in one embodiment, to at least one, optionally including more than one, A, with no B present (and optionally including elements other than B); in another embodiment, to at least one, optionally including more than one, B, with no A present (and optionally including elements other than A); in yet another embodiment, to at least one, optionally including more than one, A, and at least one, optionally including more than one, B (and optionally including other elements); etc.

It should also be understood that, unless clearly indicated to the contrary, in any methods claimed herein that include more than one step or act, the order of the steps or acts of the method is not necessarily limited to the order in which the steps or acts of the method are recited.

In the claims, as well as in the specification above, all transitional phrases such as "comprising," "including," "carrying," "having," "containing," "involving," "holding," "composed of," and the like are to be understood to be open-ended, i.e., to mean including but not limited to. Only the transitional phrases "consisting of" and "consisting essentially of" shall be closed or semi-closed transitional phrases, respectively, as set forth in the United States Patent Office Manual of Patent Examining Procedures, Section 2111.03.

It is to be understood that the embodiments are not limited in its application to the details of construction and the arrangement of components set forth in the description or illustrated in the drawings. The invention is capable of other embodiments and of being practiced or of being carried out in various ways. Unless limited otherwise, the terms "connected," "coupled," "in communication with," and "mounted," and variations thereof herein are used broadly and encompass direct and indirect connections, couplings, and mountings. In addition, the terms "connected" and "coupled" and variations thereof are not restricted to physical or mechanical connections or couplings.

The foregoing description of several embodiments of the invention has been presented for purposes of illustration. It is not intended to be exhaustive or to limit the invention to the precise steps and/or forms disclosed, and obviously many modifications and variations are possible in light of the above teaching.

What is claimed is:

1. A cooking appliance comprising:

a cooktop including at least one cooking element within or beneath a surface for receiving a cooking vessel;

a double oven beneath said cooktop, said double oven including a first oven and a second oven, said first oven powered by a first power source and having a first heat source, said first oven including a baking mode of operation at a range of temperatures between approximately 100 degrees Fahrenheit and approximately 550 degrees Fahrenheit, and a self-cleaning mode of operation at a range of temperatures greater than said range of baking temperatures and less than approximately 900 degrees Fahrenheit;

said second oven further comprising a combined toaster oven and air fryer cavity, said cavity having a rear side, a left side, a right side, a bottom, and a top; said second oven powered by a second power source and having a second heat source; said second power source and second heating source being electricity, and said second heat source including a plurality of bake elements and a plurality of broil elements selected from the group consisting of graphite, quartz, and exposed nichrome wire, wherein said plurality of bake elements are located at said bottom, wherein said plurality of broil elements are located at said top; and said second oven further comprising a fan disposed at the rear side of the second oven behind a second fan cover, and wherein said second fan cover is configured to directly guide forced air from the fan horizontally across both said plurality of broil elements at said top and said plurality of baking elements at said bottom and provide heated targeted air flow directly onto a food load that is placed inside said second oven, and wherein said second fan cover includes one or more vents positioned both in a first horizontal plane containing said plurality of baking elements at said bottom and in a second horizontal plane containing said plurality of broil elements at said top.

2. The cooking appliance of claim 1, wherein said first power source is electricity and said first heat source is selected from the group comprising electricity, natural gas, propane, and LP gas.

3. The cooking appliance of claim 1, wherein the second oven is located above the first oven.

4. The cooking appliance of claim 1, wherein said second oven includes a food rack having the same width as a food rack in said first oven.

5. The cooking appliance of claim 1 wherein said fan of said second oven operates at a higher speed than a fan of said first oven.

6. The cooking appliance of claim 1 further comprising one or more reflectors between said broil elements and said top and one or more reflective surfaces between said baking elements and said bottom.

7. The cooking appliance of claim 1 wherein said plurality of baking elements and said plurality of broil elements are graphite elements.

8. The cooking appliance of claim 1 wherein said first oven includes a first fan cover, wherein said second fan cover is different from said first fan cover.

9. A cooking appliance comprising:

a cooktop including at least one cooking element within or beneath a surface for receiving a cooking vessel;

a double oven beneath said cooktop, said double oven including a first oven and a second oven, said first oven being a self-cleaning oven and being located below said second oven, said first oven powered by a first power source and having a first heat source configured to heat a plurality of bake elements and a plurality of broil elements, said first oven including a convection fan;

said second oven further comprising a combined toaster-oven and air fryer cavity, said cavity having a rear side, a left side, a right side, a bottom, and a top; said second oven powered by a second power source and having a second heat source; said second power source and second heat source being electricity, and said second heat source including a plurality of graphite bake heating elements and a plurality of graphite broil elements; said second oven further comprising a fan located at said rear side behind a fan cover and wherein said fan cover is configured to direct forced air flow towards at least one of said plurality of graphite bake heating elements and/or said plurality of graphite broil elements to provide targeted air flow directly onto a food load that is placed inside said second oven;

a baking rack spanning from said left side to said right side; and a tray inserted between said bottom and said baking rack spanning and engaging said left side to said right side enclosing said plurality of graphite bake heating elements with said bottom, wherein said tray includes a rear edge adjacent said rear side, and wherein said fan cover directs forced air flow from said fan above said rear edge of said tray adjacent said rear side and below said rear edge of said tray adjacent said rear side towards said plurality of graphite bake heating elements enclosed between said tray and said bottom.

10. The cooking appliance of claim 9, wherein said first power source is electricity and said first heat source is selected from the group comprising electricity, natural gas, propane, and LP gas.

11. The cooking appliance of claim 9, wherein said fan cover includes one or more vents positioned at an elevation both above and below said tray to direct forced air flow above and below said rear edge of said tray adjacent said rear side.

12. The cooking appliance of claim 9, wherein said tray is made from a material selected from the group consisting of tempered glass, ceramic glass, aluminum, metal, and metal alloys.

13. The cooking appliance of claim 9 wherein said plurality of graphite bake heating elements are located at said bottom and said plurality of graphite broil elements are located at said top.

14. A cooking appliance comprising:

a cooktop including at least one cooking element within or beneath a surface for receiving a cooking vessel;

a double oven beneath said cooktop, said double oven including a first oven and a second oven, said first oven being a self-cleaning oven and being located below said second oven, said first oven powered by a first power source and having a first heat source configured to heat a plurality of bake elements and a plurality of broil elements, said first oven including a convection fan positioned behind a first fan cover; and said second oven further comprising a combined toaster oven and air fryer cavity, said cavity having a rear side, a left side, a right side, a bottom, and a top; said second oven powered by a second power source and having a second heat source; said second power source and second heat source being electricity, and said second heat source including a plurality of graphite bake heating elements located at said bottom and a plurality of graphite broil elements located at said top; said second oven further comprising a fan located at said rear side behind a second fan cover and wherein said second fan cover includes a different pattern of vents than said first fan cover configured to provide targeted air flow directly onto a food load that is placed inside said second oven; and wherein said pattern of vents of said second fan cover are positioned both in a first horizontal plane containing said plurality of graphite bake heating elements located at said bottom and in a second horizontal plane containing said plurality of graphite broil elements located at said top.

15. The cooking appliance of claim 14 wherein said second oven includes one or more reflective portions adjacent said second heat source.

16. The cooking appliance of claim 14 wherein said pattern of vents of said second fan cover extends from said first horizontal plane containing said plurality of graphite bake heating elements to said second horizontal plane containing said plurality of graphite broil elements.

17. The cooking appliance of claim 14 wherein exiting air flow from said pattern of vents of said second fan cover is directed in said first horizontal plane containing said plurality of graphite bake heating elements and in said second horizontal plane containing said plurality of graphite broil elements.

* * * * *